US005975049A

United States Patent [19]

Kawasaki

[11] Patent Number: 5,975,049

[45] Date of Patent: Nov. 2, 1999

[54] IDLING SPEED CONTROL SYSTEM OF INTERNAL COMBUSTION ENGINE

[75] Inventor: Takao Kawasaki, Kanagawa, Japan

[73] Assignee: Nissan Motor Co., Ltd., Yokohama, Japan

[21] Appl. No.: 09/124,061

[22] Filed: Jul. 29, 1998

[30] Foreign Application Priority Data

Jul. 30, 1997 [JP] Japan ..... 9-204460

[51] Int. Cl.[6] ..... F02D 41/16; F02D 41/08

[52] U.S. Cl. ..... 123/339.12; 123/339.16; 123/339.17; 123/339.18

[58] Field of Search ..... 123/339.23, 339.12, 123/339.16, 339.17, 339.18, 339.19

[56] References Cited

U.S. PATENT DOCUMENTS

| | | | |
|---|---|---|---|
| 4,611,560 | 9/1986 | Miyazaki et al. | 123/339 |
| 4,883,034 | 11/1989 | Yashiki et al. | 123/339 |
| 5,253,624 | 10/1993 | Anzai et al. | 123/339 |

FOREIGN PATENT DOCUMENTS 54-76723 6/1979 Japan .

*Primary Examiner*—Andrew M. Dolinar
*Assistant Examiner*—Mahmoud M. Gimie
*Attorney, Agent, or Firm*—Foley & Lardner

[57] ABSTRACT

An internal combustion engine has an auxiliary device incorporated therewith. An idling speed control device of the engine includes a first air amount control device which controls the amount of air fed to the engine in accordance with an operation condition of the engine, a second air amount control device which controls the amount of air fed to the engine when a load of the auxiliary device is being applied to the engine; and an air/fuel varying device which varies an air/fuel ratio of a mixture fed to the engine. A control unit for the idling speed control device includes a judging unit which judges whether the load of the auxiliary device is actually applied to the engine or not; a first deriving unit which derives a corrected air amount which corresponds to a load of the auxiliary device under idling operation of the engine at a stoichiometric air/fuel ration; a second deriving unit which derives a needed air amount needed by the engine when the engine is idling at a target air/fuel ratio; a calculating unit which calculates a difference between the corrected air amount and the needed air amount when the judging unit judges the application of the load of the auxiliary device to the engine; and an air amount control unit which controls the first air amount control device to correct the air amount fed to the engine in accordance with the difference calculated by the calculating unit.

13 Claims, 9 Drawing Sheets

IDLING SPEED CONTROL SYSTEM OF INTERNAL COMBUSTION ENGINE

BACKGROUND OF THE INVENTION

1. Field of the Invention

The present invention relates in general to idling speed control systems of an internal combustion engine, and more particularly to the idling speed control systems of a type which can keep the idling driveability of the engine well even when a certain load of an auxiliary device is applied to the output of the engine.

2. Description of the Prior Art

For keeping the idling driveability of an engine in a satisfied level even when a load of an auxiliary device, such as air conditioner, power steering pump or the like, is applied to the output of the engine, various control systems have been hitherto proposed and put into practical use. Usually, in such control systems, the amount of air fed to the engine is increased upon sensing the load. One of these control systems is disclosed in Japanese Patent First Provisional Publication 54-76723. That is, in the measure of this publication, when, with the engine being under idling, an air conditioner is turned ON, the idling speed of the engine is increased to a target value by increasing the amount of air fed to the engine, the target value being looked up from a map. With that measure, undesired engine stop and/or performance deficiency of the air conditioner is suppressed.

SUMMARY OF THE INVENTION

However, hitherto, usage of such idling speed control system in a so-called "lean-burn or direct injection gasoline engine" has been given little thought. As is known, the direct injection gasoline engine has a fuel injector located inside the combustion chamber so that the fuel is injected directly into the cylinder. Due to the nature of such engine, idling may be carried out with combustion of stratified charge of an ultra-lean mixture, resulting in improvement in fuel economy. However, as is known, combustion of stratified lean mixture is very sensitive to a load applied to the engine, and thus, if the above-mentioned conventional idling speed control system is simply applied to the direct injection gasoline engine, it tends to occur that the engine fails to exhibit or keep a satisfied idling driveability upon receiving a load from an auxiliary device.

It is therefore an object of the present invention to provide a control system and a control method, which can keep well the idling driveability of an internal combustion engine, such as a direct injection gasoline engine or the like, even when a load of an auxiliary device is applied to the engine.

According to the present invention, there is provided an idling speed control system of an internal combustion engine which has an auxiliary device incorporated therewith. The idling speed control system comprises a first air amount control device which controls the amount of air fed to the engine in accordance with an operation condition of the engine; a second air amount control device which controls the amount of air fed to the engine when a load of the auxiliary device is being applied to the engine; and an air/fuel ratio varying device which varies an air/fuel ratio of a mixture fed to the engine. A control unit employed in the idling speed control system comprises a judging unit which judges whether the load of the auxiliary device is actually applied to the engine or not; a first deriving unit which derives a corrected air amount which corresponds to a load of the auxiliary device under idling operation of the engine at a stoichiometric air/fuel ratio; a second deriving unit which derives a needed air amount needed by the engine when the engine is idling at a target air/fuel ratio; a calculating unit which calculates a difference between the corrected air amount and the needed air amount when the first section judges the application of the load of the auxiliary device to the engine; and a an air amount control unit section which controls the first air amount control device to correct the air amount fed to the engine in accordance with the difference calculated by the calculating unit.

DETAILED DESCRIPTION OF THE INVENTION

Figure 1:
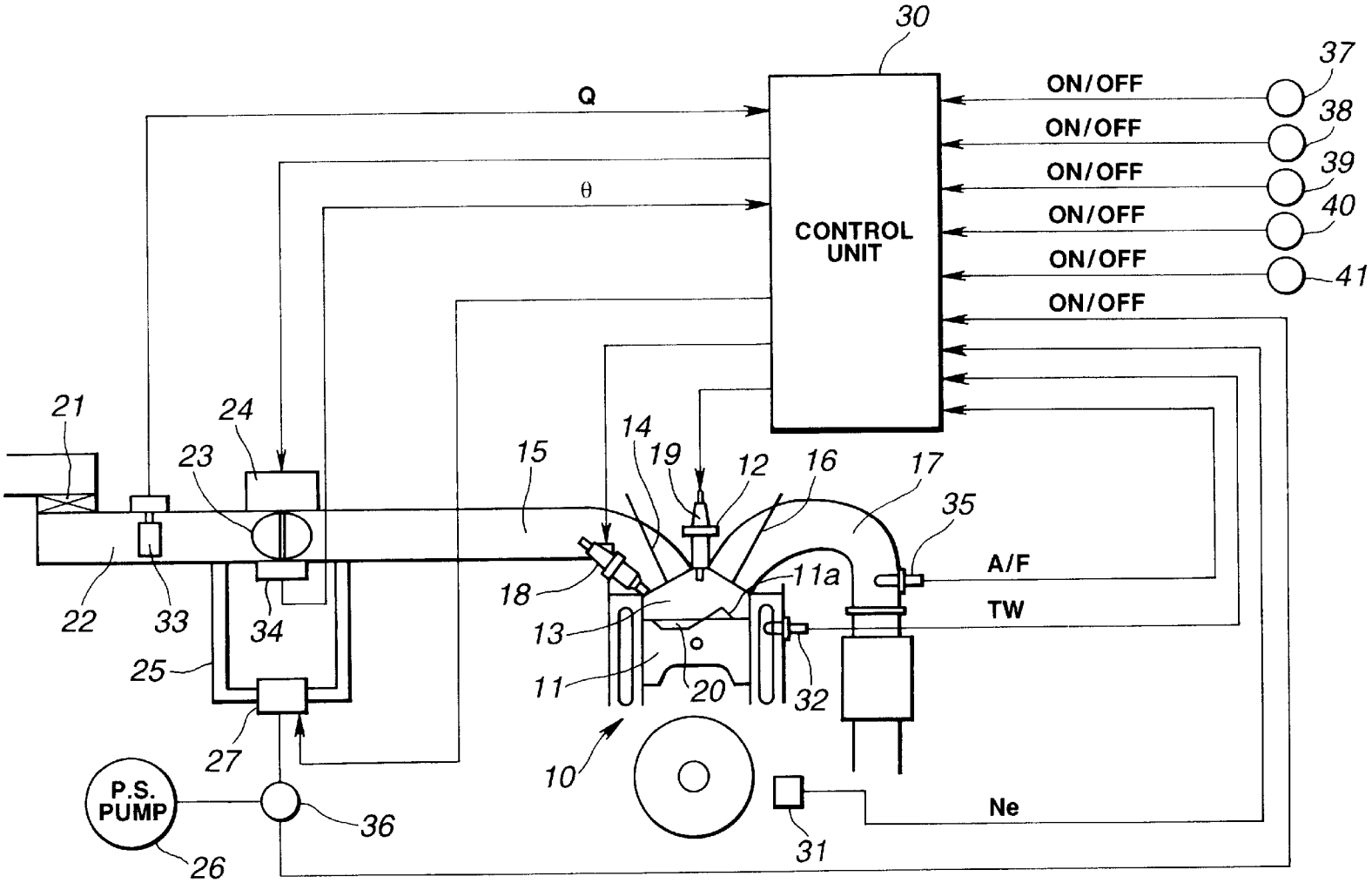
FIG. 1 is a schematic view of a direct injection gasoline engine to which an idling speed control system of the present invention is practically applied.

Referring to FIG. 1 of the drawings, there is schematically shown an idling speed control system of the present invention, which is practically applied to a direct injection gasoline engine 10.

The direct injection gasoline engine 10 has a combustion chamber 13 which is defined between an upper surface 11*a* of a piston 11 and a lower surface of a cylinder head 12. The cylinder head 12 has two intake ports 15 led to an upper portion of the combustion chamber 13. Each intake port 15 is equipped with an intake valve 14 to open and close the port 15. The cylinder head 12 has further two exhaust ports 17 extending from the upper portion of the combustion chamber 13. Each exhaust port 17 is equipped with an exhaust valve 16.

Between the two intake ports 15, there is arranged a fuel injector 18 whose injection nozzle is directed toward the combustion chamber 13. At an upper portion of the combustion chamber 13, there is arranged an ignition plug 19. Thus, under operation of the engine 10, fuel is directly injected into the combustion chamber 13 by the fuel injector 18, and an air/fuel mixture in the combustion chamber 13 is ignited by the ignition plug 19. As shown, the upper surface 11*a* of the piston 11 is formed with a cavity 20 at a position below an imaginary line connecting the fuel injector 18 and the ignition plug 19.

Under operation of the engine 10, air is led to the combustion chamber 13 through an air cleaner 21, an air intake duct 22, the intake ports 15 and the intake valves 14. Within the air intake duct 22, there is arranged an electronically controlled throttle valve 23 which is actuated by an actuator 24. That is, in accordance with an operation condition of the engine 10, the amount "Q" of air fed to the engine 10 is controlled. More specifically, the open degree of the throttle valve 23 is controlled in accordance with a target torque of the engine which is calculated based on a request by a driver (viz., stroke speed of accelerator pedal, depression degree of accelerator pedal, etc.,) and an operation condition of the associated motor vehicle (viz., vehicle speed, engine speed, etc.,). The detail of this system is described in U.S. patent application Ser. No.08/804,454 filed Feb. 21, 1997 and U.S. patent application Ser. No. 09/102,366 filed Jun. 23, 1998 based on Japanese Patent Application 9-167613.

Under low and medium load region, fuel injection by the fuel injector 18 is made near the end of compression stroke to create a stratified mixture under the ignition plug 19 for a stratified charge combustion. While, under a high load region, the fuel injection is made during the intake stroke to create a homogenous mixture in the combustion chamber 13 for a homogenous charge combustion. The fuel injector 18 and the throttle valve 23 constitute part of an air/fuel ratio varying means.

To the air intake duct 22, there is connected a bypass passage 25 which bypasses the throttle valve 23. That is, an upstream end of the bypass passage 25 is connected to the air intake duct 22 at a position upstream of the throttle valve 23 and a downstream end of the bypass passage 25 is connected to the air intake duct 22 at a position downstream of the throttle valve 23. The bypass passage 25 has therein an electronically controlled bypass valve 27. The bypass valve 27 opens the bypass passage 25 when a power steering pump 26 is energized.

Operation of the engine 10 is controlled by a control unit 30 which comprises a microcomputer. To the control unit 30, there are inputted various information signals, which are a signal from a crank angle sensor 31 representing an engine speed "Ne", a signal from a water temperature sensor 32 representing a cooling water temperature "Tw", a signal from an air flow meter 33 representing the intake air amount "Q", a signal from an open degree sensor 34 representing an open degree "θ" of the above-mentioned throttle valve 23, a signal from an air/fuel ratio sensor 35 representing an air/fuel ratio in the combustible mixture, a signal from a power steering switch 36 representing ON/OFF condition of a power steering, a signal from an air conditioner switch 37 representing ON/OFF condition of an air conditioner, a signal from a radiator fan switch 38 representing ON/OFF condition of a radiator fan, a signal from a load switch 39 representing ON/OFF condition of an alternator, a signal from an air conditioner relay 40 representing ON/OFF condition of a compressor of the air conditioner, and a signal from a radiator fan relay 41 representing ON/OFF condition of a motor of a radiator fan. The power steering switch 36 issues ON signal when a discharge pressure of the power steering pump 26 exceeds a predetermined level, and the air conditioner switch 37 issues ON signal when manipulated by an operator (viz., driver) for turning ON the air conditioner. The air conditioner switch 37 may be of an automatic type which is automatically turned ON when the temperature of a passenger room increases to a given level. Upon receiving ON signal from the control unit 30, the air conditioner relay 40 establishes a circuit to operatively drive the compressor. That is, upon establishment of the circuit, ON signal is issued from the relay 40.

By processing the information signals inputted thereto, the control unit 30 judges the existing condition of the engine 10. Based on this judged condition, the control unit 30 controls the open degree "θ" of the throttle valve 23 and an ignition timing of the ignition plug 19. The ON/OFF signal from the power steering switch 36 is fed also to the electronically controlled bypass valve 27.

The control unit 30 has various functions, such as a feedback control, derivation of corrected air amount, derivation of needed air amount, calculation of difference between the corrected air amount and the needed air amount, correction of intake air amount, detection of intake vacuum and correction on air flow timing delay. The control unit 30 and the power steering switch 36 constitute a so-called "load application judging means" as will be clarified hereinafter. If desired, in addition to the electrically controlled bypass valve 27, another electrically controlled valve may be provided which opens and closes the bypass passage 25 in accordance with operation of the air conditioner, the radiator fan and/or the alternator.

Figure 2:
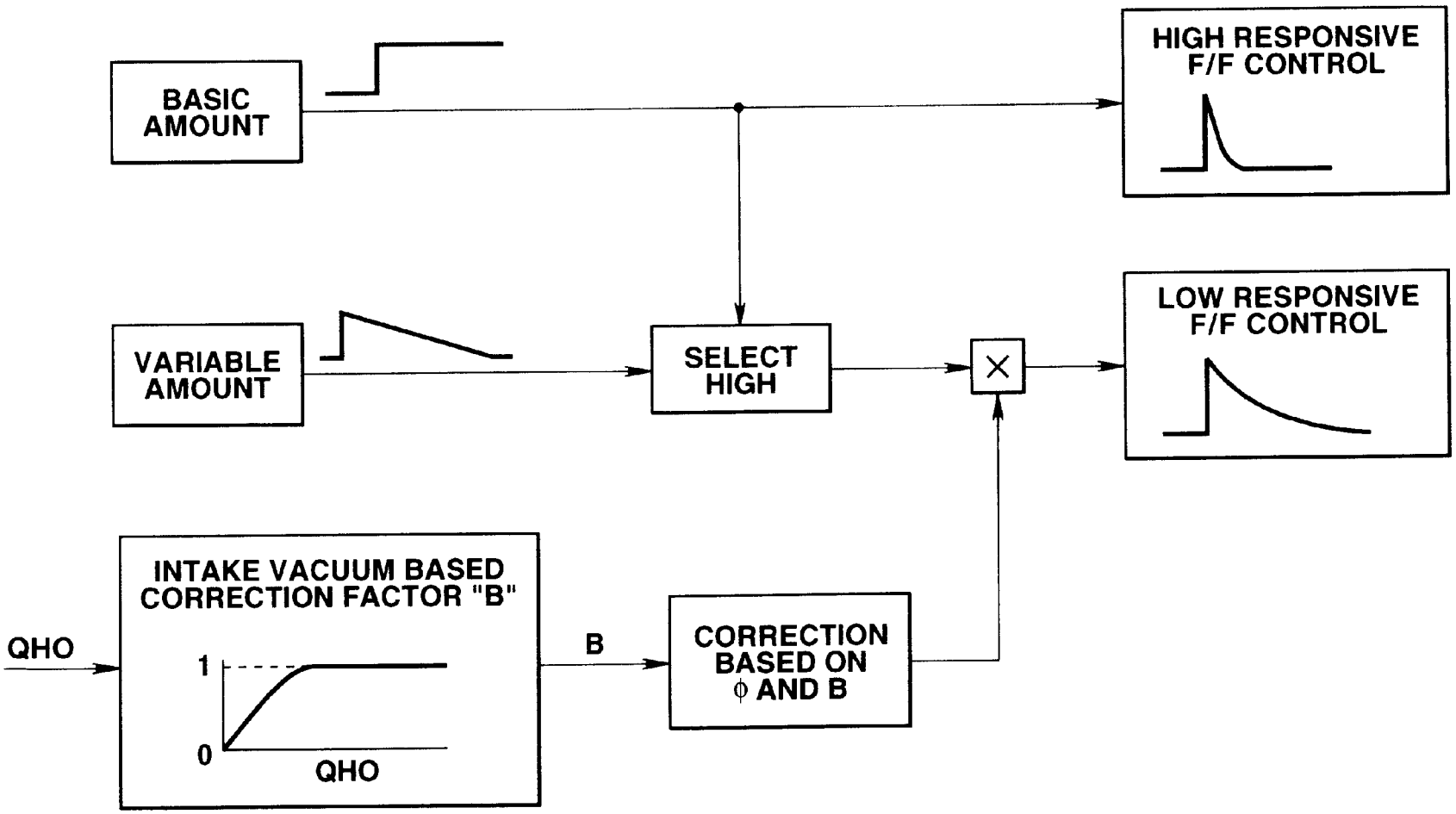
FIG. 2 is a block diagram showing an air amount correction control effected based on a load of a power steering pump.

In the following, correction of air amount to be carried out when, under idling operation with combustion of stratified charge, a load of the power steering pump 26 is actually applied to the output of the engine will be described with reference to FIG. 2.

(1) Correction based on equivalent ratio "ϕ" (=1/λ)

Figure 4:
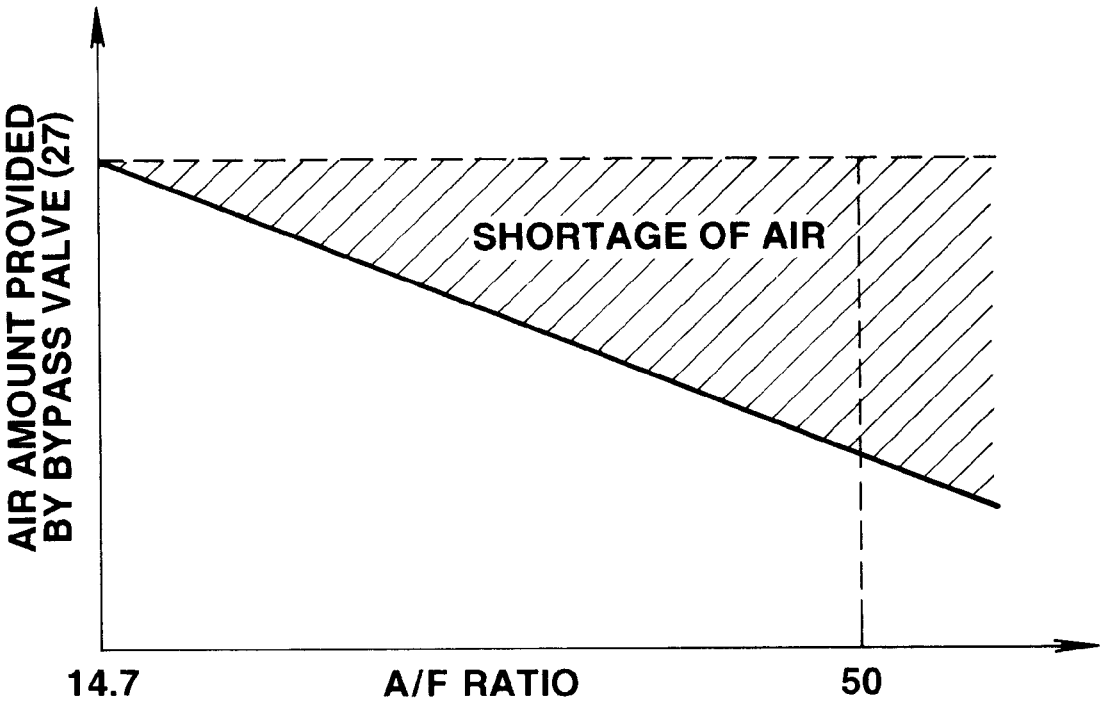
FIG. 4 is a graph depicting a shortage of air which would occur if the air supply to the engine is made by only a bypass valve.

Under combustion of a mixture of stoichiometric air/fuel ratio, the correction of air amount fed to the engine 10 needed due to application of load of the power steering pump 26 is carried out by actuating only the bypass valve 27 in the bypass passage 25. That is, by only controlling the bypass valve 27, an additional air corresponding the load of the power steering pump 26 is obtained. However under combustion of stratified charge wherein the air/fuel ratio is high, that is, the air/fuel mixture is lean, a larger amount of air is needed and thus as shown in FIG. 4, under such combustion, the air amount actually needed by the engine 10 becomes insufficient if the correction of air amount is conducted by the bypass valve 27. For eliminating this shortage of air, the following measure is provided in the present invention.

First, a corrected air amount "C" (viz., amount of air in shortage) is calculated from the following equation:

$$C=X-Y \tag{1}$$

wherein:

X: needed air amount (viz., amount of air theoretically needed to flow through bypass valve 27)

Y: actually flowing air amount (viz., amount of air actually flowing through bypass valve 27)

Since the actually flowing air amount varies in accordance with the air/fuel ratio of the engine 10, the following correction is necessary to the actually flowing air amount.

$$Ya = (\text{actually flowing air amount "}Y\text{" under combustion of mixture of stoichiometric air/fuel ratio}) \times (\text{equivalent ratio "}\phi\text{"}) \tag{2}$$

Figure 3:
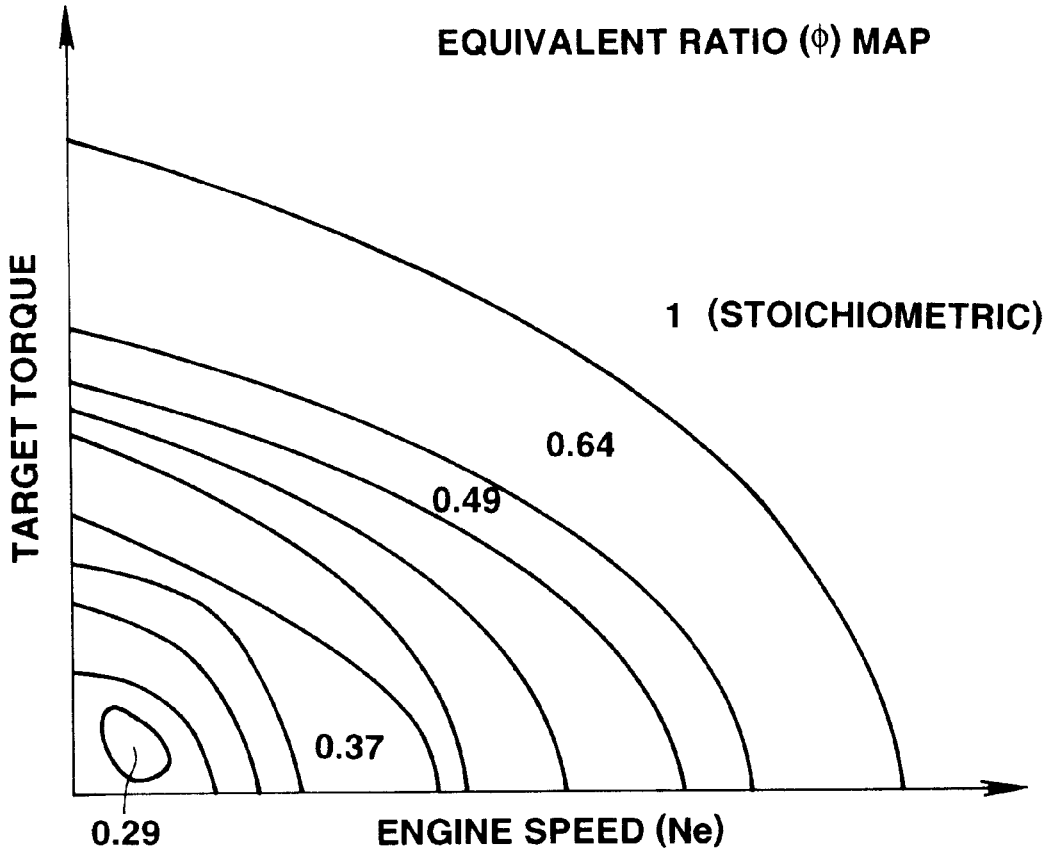
FIG. 3 is a map for an equivalent ratio corresponding to an engine operating condition determined by a target torque and an actual engine speed.

The equivalent ratio "ϕ" is provided by looking up from a map such as the one as shown in FIG. 3. The map provides a set equivalent ratio "ϕ" corresponding to the engine operating condition determined by the target torque and the actual engine speed "Ne". Details of such map is set forth in U.S. patent application Ser. No. 08/901,963 filed Jul. 29, 1997 and titled "Control System for Internal Combustion Engine."

(2) Correction based on intake vacuum

With increase of air/fuel ratio, the amount of air needed by the engine 10 increases and thus the amount of air flowing in the intake duct 22 increases, which lowers the intake vacuum in the intake duct 22. Accordingly, the amount of air flowing in the intake duct 22 is reduced even when the bypass valve 27 is fully opened. Thus, it becomes necessary to correct the actually flowing air amount with respect to the intake vacuum.

The correction is made as follows.

$$Yb = (\text{actually flowing air amount "}Y\text{" under combustion of mixture of stoichiometric air/fuel ratio}) \times (\text{equivalent ratio "}\phi\text{"}) \times (\text{intake vacuum based correction factor "}B\text{"})$$

It is to be noted that the intake vacuum based correction factor "B" is looked up from a map provided based on an intake vacuum corresponding value "QHO". This value "QHO" is calculated from the following equation.

$$QHO = Ne \times V/\theta \quad (3)$$

wherein:

Ne: engine speed

V: engine displacement

θ: open degree of throttle valve

It is to be noted that the intake vacuum based correction factor "B" satisfies the following inequality.

$$0 \leqq B \leqq 1 \quad (4)$$

If desired, in place of the intake vacuum corresponding value "QHO" calculated, an intake vacuum directly sensed by a sensor mounted in the intake duct 22 may be used for obtaining the correction factor "B".

(3) Correction of needed air amount

The actually flowing air amount "Y" under combustion of mixture of stoichiometric air/fuel mixture varies in accordance with a load of the power steering pump 26. Since the load can not be directly sensed, the corrected air amount is calculated from the following equation regarding that the load corresponds to the needed air amount "X".

$$\begin{aligned}\text{corrected air amount} &= (\text{needed air amount "}X\text{"}) - (\text{needed air amount "}X\text{"} \times \text{equivalent ratio "}\phi\text{"} \times \text{intake vacuum correction factor "}B\text{"}) \\ &= (\text{needed air amount "}X\text{"}) \times (1 - \text{equivalent ratio "}\phi\text{"} \times \text{intake vacuum correction factor "}B\text{"})\end{aligned} \quad (5)$$

(4) Needed air amount "X"

Figure 5A:
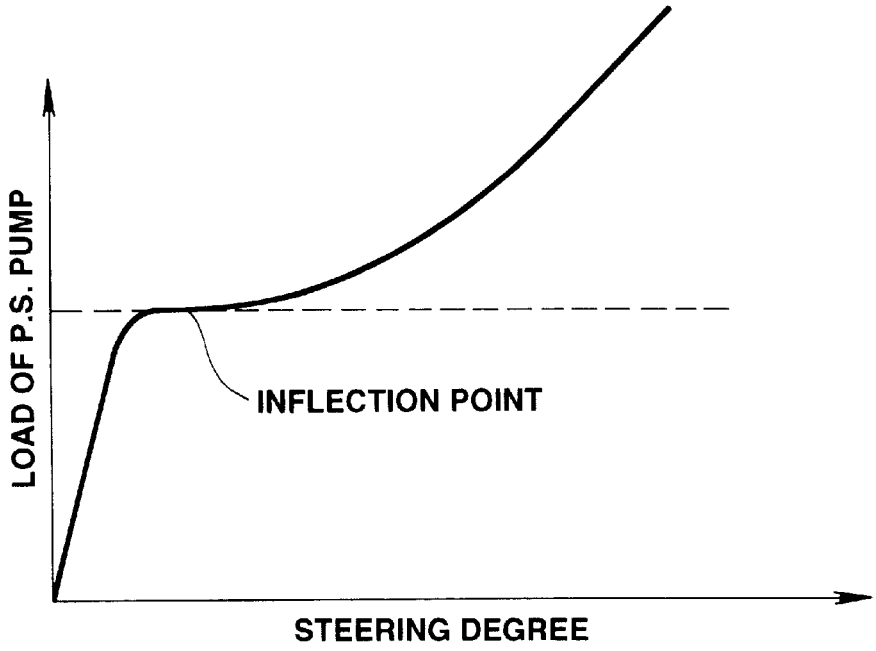
FIG. 5A is a graph showing a relationship between a rotation degree of a steering wheel and a load of a power steering pump.
Figure 5B:
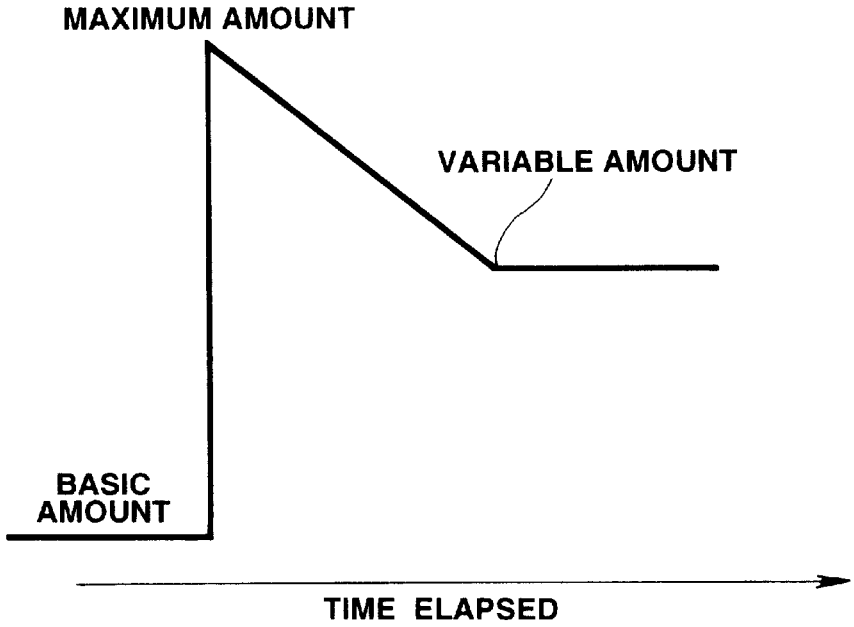
FIG. 5B is a view depicting a corrected amount of air with respect to the load of the power steering pump.

As is understood from a characteristic curve of FIG. 5A, the load of the power steering pump 26 varies in accordance with a steering degree. That is, upon starting of the steering, the load of the power steering pump 26 instantly rises to an inflection point of the curve and thereafter the load increases gradually with increase of steering degree. As is mentioned hereinabove, the load can not be directly detected. Accordingly, as will be understood from FIG. 5B, the needed air amount "X" is selected from a larger one of a basic amount (fixed value) corresponding to the inflection point of the curve of FIG. 5A and a variable amount corresponding to a point of the gradually increasing section of the curve of FIG. 5A. It is to be noted that the peak denoted by "MAXIMUM AMOUNT" in FIG. 5B is an initial value corresponding to a maximum load of the power steering pump 26, and the value gradually lowers with passage of time. It is further to be noted that the lowering rate of the initial value is so determined as to allow a feed-back control of the air amount fed to the engine 10.

To deal with an air flow timing delay caused by the nature (viz., compressible) of air, a high responsive F/F (feed-forward) control is applied to the ignition timing and fuel injection amount with respect to the base amount. In fact, between the time when the load of the power steering pump 26 is detected and the time when the actually needed amount of air is led into the cylinder, there is inevitably a time gap which causes the air flow timing delay.

As will be understood from the above, when, due to starting of the power steering pump 26, a load of the pump 26 is applied to the engine, the ignition timing and the injected fuel amount are corrected, through a high responsive F/F (feed-forward) control, based on a corrected air amount corresponding to the load of the power steering pump 26.

In addition to the above, based on the intake vacuum based correction factor "B", an equivalent ratio "ϕ" and a correction factor "(1−θ×B)" for the intake vacuum are calculated, and then the correction factor "(1−ϕ×B)" is multiplied by the above-mentioned lager one of the basic amount and the variable amount to provide a corrected air amount. Based on the corrected air amount, the electronically controlled bypass valve 27 in the bypass passage 25 is actuated through a low responsive F/F (feed-forward) control. It is to be noted that the low responsive F/F control is the control carried out without respect to the air flow timing delay.

Figure 6:
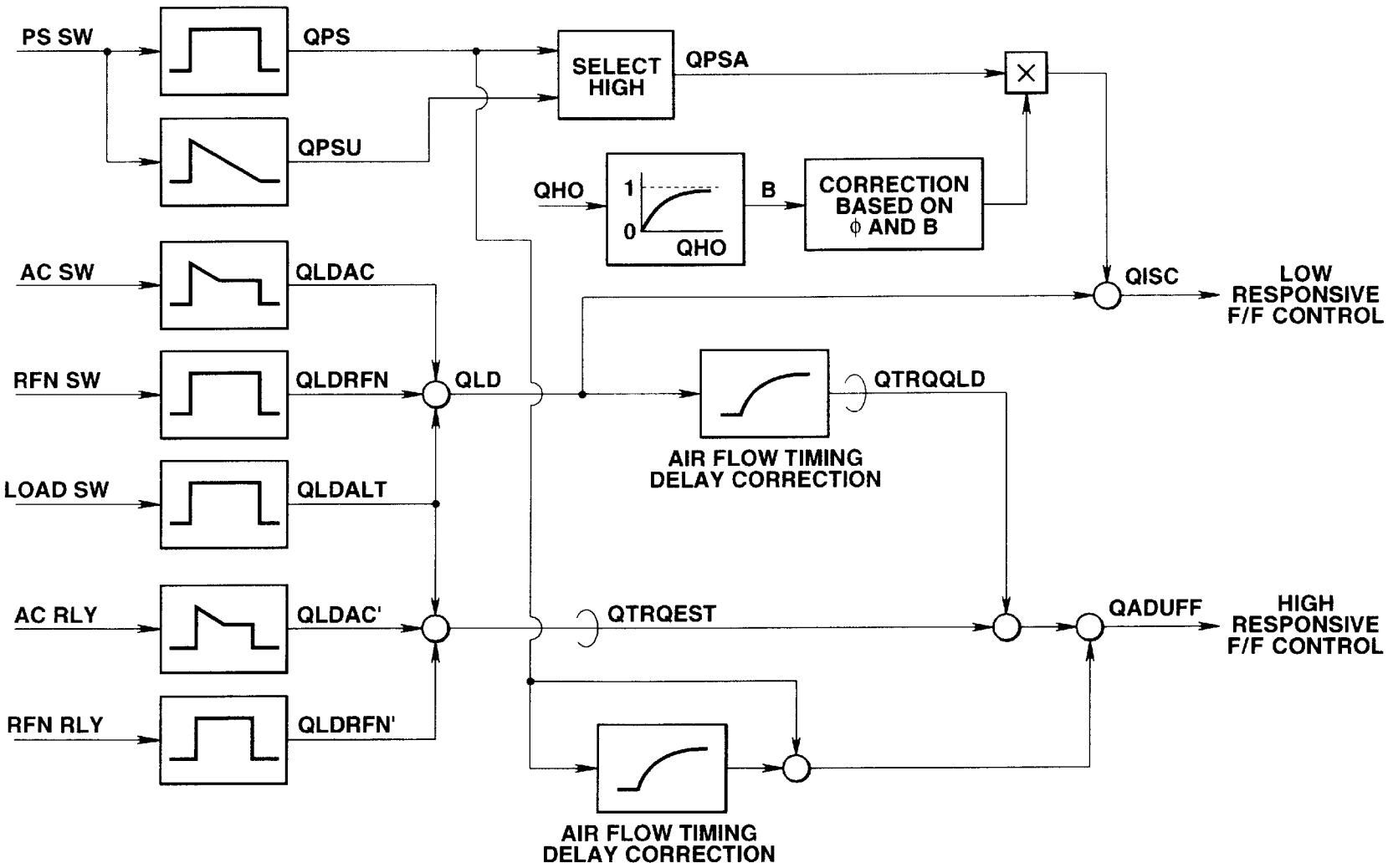
FIG. 6 is a block diagram showing the entire of the air amount correction control executed in the idling speed control system of the invention.

FIG. 6 is a block diagram showing the entire of the air amount correction control executed in the idling speed control system of the invention. More specifically, FIG. 6 shows an example in which the air amount correction effected by the operation of the power steering pump 26 is combined with an air amount correction effected by the operation the air conditioner, the radiator fan and the alternator.

Figure 7:
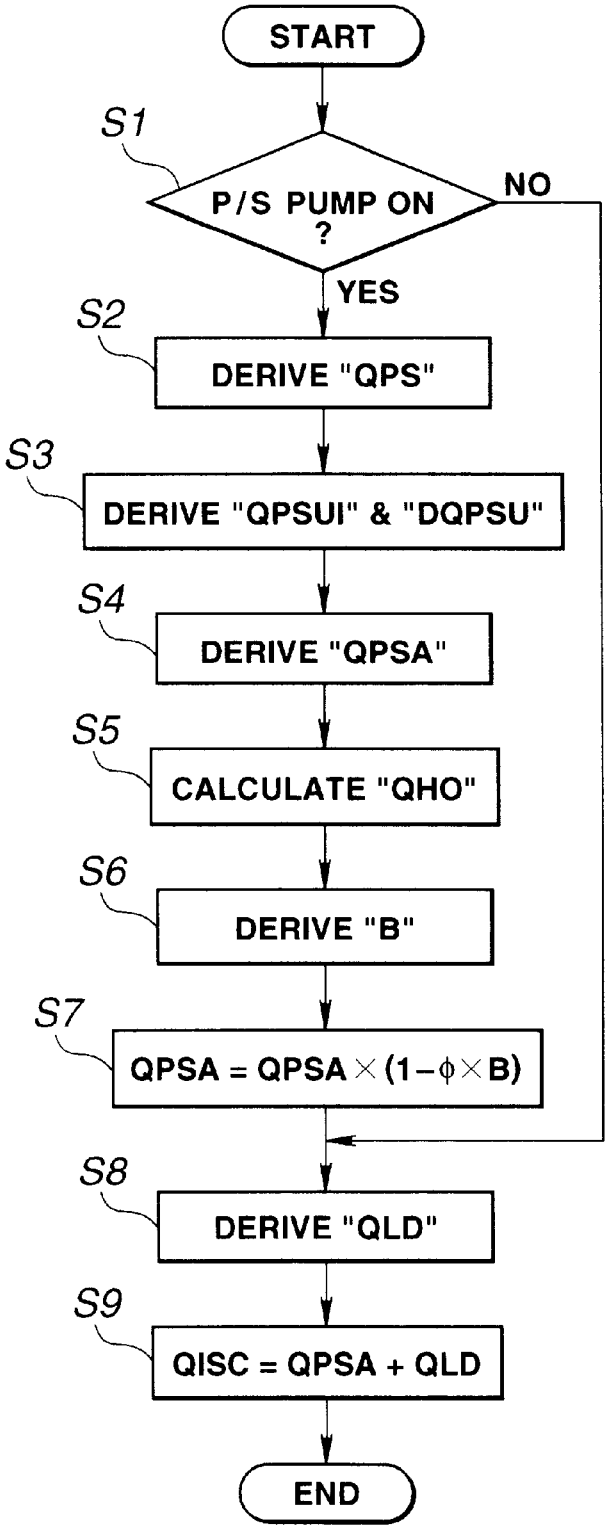
FIG. 7 is a flowchart showing programmed operation steps executed for carrying out the air amount correction control for a low responsive feed-forward control.

First, the air amount correction for the low responsive F/F control will be described with reference to FIGS. 6 and 7. FIG. 7 is a flowchart showing programmed operation steps executed for the low responsive F/F control.

In the flowchart of FIG. 7, at step S1, judgment is carried out as to whether, based on a signal "PSSW" (see FIG. 6) from the power steering switch 36, the power steering pump 26 is under operation or not. If YES, that is, when the power steering pump 26 is under operation, the operation flow goes to step S2. While, if NO, that is, when the power steering pump 26 is not under operation, the operation flow goes to step S8. At step S2, a maximum corrected air amount "QPS" which is achieved by the bypass valve 27 while keeping combustion of a mixture of stoichiometric air/fuel ratio is derived. This derivation is achieved by looking up a selected map stored in a ROM (read only memory) installed in the control unit 30. After step S2, the operation flow goes to step S3. At this step S3, a corrected air amount initial value "QPSUI" which corresponds to a maximum load of the power steering pump 26 and a reducing rate "DQPSU" at which the corrected air amount initial value "QPSUI" reduces to zero (0) after a predetermine time are derived. This derivation is also effected by looking up a selected map stored in the control unit 30. From the following equation (6), a corrected air amount "QPSU" at the time when a time "t" has passed after operation of the power steering pump 26 is calculated.

$$QPSU=QPSUI-DQPSU\times t \quad (6)$$

Then, at step S4, by comparing the corrected air amount "QPS" derived at step S2 with the corrected air amount "QPSU" calculated at step S3, a larger or higher one is selected and set as a corrected air amount "QPSA".

At step S5, based on the throttle valve open degree "θ" sensed by the sensor 34, the engine speed "Ne" sensed by the sensor 31 and the engine displacement of the engine 10, the value "QHO" corresponding to the intake vacuum in the intake duct 22 is calculated by using the above-mentioned equation (3).

At step S6, the intake vacuum based correction factor "B" is looked up from a map provided based on the intake vacuum corresponding value "QHO". As is seen from the block diagram of FIG. 6, the factor "B" has 0 (zero) as an initial value and is gradually increased with increase of the value "QHO" and saturated at 1 (one).

At step S7, by using the equivalent ratio "ϕ" and the intake vacuum based correction factor "B", the corrected air amount "QPSA" is further corrected by using the following equation (7).

$$QPSA=QPSA\times(1-\phi\times B) \quad (7)$$

At step S8, a corrected air total amount "QLD" corresponding to a total load of the air conditioner, the radiator fan and the alternator is derived. This derivation is carried out by taking the following steps.

(s-1) By processing the signal "ACSW" (see FIG. 6) from the air conditioner switch 37, judgment is carried out as to whether the air conditioner is under operation or not. If YES, that is, when the air conditioner is ON, a corrected air amount "QLDAC" corresponding to a load of the compressor is looked up from a map. The corrected air amount "QLDAC" shows a maximum value just after ON condition of the compressor, then gradually reduces at a given reducing rate with passage of time and shows a constant value after a given time.

(s-2) By processing the signal "RFNSW" (see FIG. 6) from the radiator fan switch 38, judgment is carried out as to whether the radiator fan is under operation or not. If YES, that is, when the radiator fan is under operation, a corrected air amount "QLDRFN" corresponding to a load of the radiator fan is looked up from a map. This corrected air amount "QLDRFN" shows a fixed value.

(s-3) By processing the signal "LOADSW" (see FIG. 6) from the load switch 39, judgment is carried out as to whether the alternator is under operation or not. If YES, that is, when the alternator is under operation, a corrected air amount "QLDALT" corresponding to a load of the alternator is looked up from a map. This corrected air amount "QLDALT" shows a fixed value.

(s-4) By using the following equation (8), a corrected air total amount "QLD" is derived.

$$QLD=QLDAC+QLDRFN+QLDALT \quad (8)$$

At step S9, by using the following equation (9), a corrected air amount "QISC" for the low responsive F/F control is derived.

$$QISC=QPSA+QLD \quad (9)$$

Based on the corrected air amount "QISC" thus derived, the control unit 30 controls the throttle valve 23 installed in the intake duct 22 so as to improve the idling operability of the engine 10.

Figure 8:
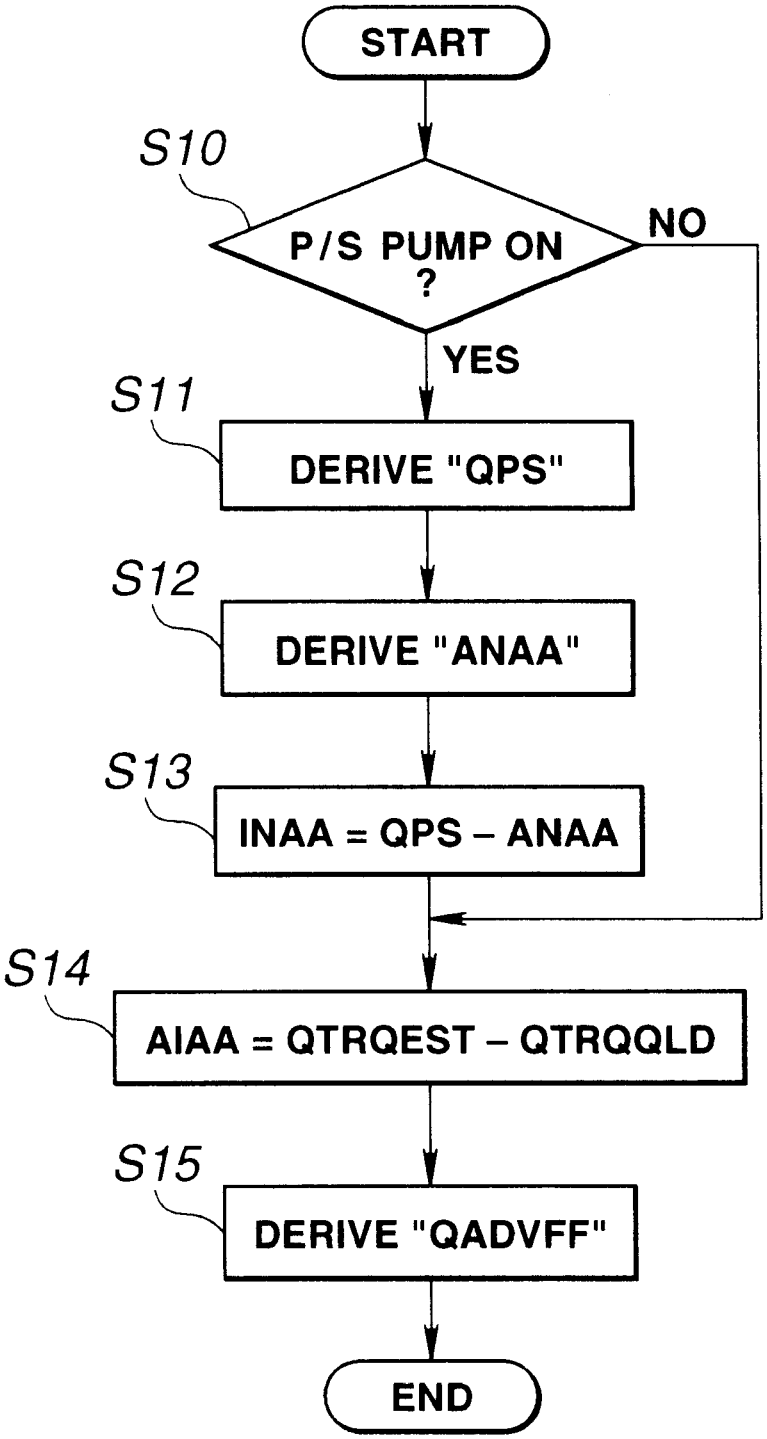
FIG. 8 is a flowchart showing programmed operation steps executed for carrying out the air amount correction control for a high responsive feed-forward control.

The air amount correction for the high responsive F/F control will be described with reference to FIGS. 6 and 8. FIG. 8 is a flowchart showing programmed operation steps executed for the high responsive F/F control.

In the flowchart of FIG. 8, at step S10, judgment is carried out as to whether, based on a signal "PSSW" (see FIG. 6) from the power steering switch 36, the power steering pump 26 is under operation or not. If YES, that is, when the power steering pump 26 is under operation, the operation flow goes to step S11. While, if NO, that is, when the power steering pump 26 is not under operation, the operation flow goes to step S14. At step S11, a maximum corrected air amount "QPS" which is achieved by the bypass valve 27 while keeping combustion of a mixture of stoichiometric air/fuel ratio is derived. This derivation is achieved by looking up a selected map stored in the ROM installed in the control unit 30. After step S11, the operation flow goes to step S12. At this step S12, to deal with an inevitable air flow timing delay, a correction is made to the corrected air amount "QPS" to derive an actually needed air amount "ANAA" which is actually fed to the engine 10. That is, with reference to a selected map showing a relationship between correction factors "cf" and elapsed time. The correction is executed by using the following equation.

$$ANAA=QPS\times cf \quad (10)$$

wherein:

cf: correction factor

At step S13, an amount of air which would be insufficient by only operating the throttle valve 23 in the air intake duct 22 is derived. For deriving the insufficient amount of air "INAA", the following equation (11) is executed.

$$INAA=QPS-ANAA \quad (11)$$

At step S14, among the corrected air amount corresponding to the load of the air conditioner, the radiator fan and the alternator, only the insufficient amount of air caused by the air flow timing delay is derived from the following steps.

(s-1) By processing the signal "ACSW" (see FIG. 6) from the air conditioner switch 37, judgment is carried out as to whether the air conditioner is under operation or not. If YES, that is, when the air conditioner is ON, a corrected air amount "QLDAC" corresponding to a load of the compressor is looked up form a map.

(s-2) By processing the signal "RFNSW" (see FIG. 6) from the radiator fan switch 38, judgment is carried out as to whether the radiator fan is under operation or not. If YES, that is, when the radiator fan is under operation, a corrected air amount "QLDRFN" corresponding to a load of the radiator fan is looked up from a map.

(s-3) By processing the signal "LOADSW" (see FIG. 6) from the load switch 39, judgment is carried out as to whether the alternator is under operation or not. If YES, that is, when the alternator is under operation, a corrected air amount "QLDALT" corresponding to a load of the alternator is looked up form a map.

(s-4) By using the following equation (12), the corrected air total amount "QLD" is derived.

$$QLD=QLDAC+QLDRFN+QLDALT \quad (12)$$

(s-5) Correction is made to the corrected air total amount "QLD" in view of an air flow timing delay to derive an actually needed air amount "QTRQQLD" which is actually fed to the engine 10. For deriving this amount "QTRQQLD", substantially the same correction process as that described in the above-mentioned step S12 is taken.

(s-6) By processing the signal "ACRLY" (see FIG. 6) from the air conditioner relay 40, judgment is carried out as to whether the compressor of the air condition is under working or not. If YES, that is, when the compressor is actually working, a corrected air amount "QLDAC'" corresponding to a load of the compressor is looked up from a map. This corrected air amount "QLDAC'" shows a maximum value just after starting of the compressor, then gradually lowers at a given reducing rate with passage of time and shows a constant value after a given time.

(s-7) By processing the signal "RFNRLY" (see FIG. 6) from the radiator fan relay 41, judgment is carried out as to whether the motor of the radiator fan is actually working or not. If YES, that is, when the motor of the radiator fan is actually working, a corrected air amount "QLDRFN'" corresponding to a load of the motor is looked up from a map. This amount "QLDRNF'" shows a fixed value.

(s-8) By using the following equation (13), a corrected air total amount "QTRQEST" is derived.

$$QTRQEST=QLDAC'+QLDRFN'+QLDALT \quad (13)$$

(s-9) By using the following equation (14), an actually insufficient air amount "AIAA" is derived.

$$AIAA=QTRQEST-QTRQQLD \quad (14)$$

At step S15, the following equation (15) is executed for deriving a corrected air amount "QADVFF" used for the high responsive F/F control.

$$QADVFF=INAA \text{ (amount derived at step S13) } +AIAA \text{ (amount derived at step S14)} \quad (15)$$

Based on the "QADVFF", the control unit 30 controls the fuel injector 18 and the ignition plug 19 in a manner to deal with the air flow timing delay.

As will be understood from the foregoing description, in the idling speed control system of the present invention, the following operation is expected.

That is, when, under idling operation of the engine 10, the power steering pump 26 becomes operated thereby to apply a certain load to the engine 10, a corrected air amount "QPSA" corresponding to a load of the power steering pump 26 under combustion of a mixture of stoichiometric air/fuel ratio in the engine 10 is derived, at first. As the corrected air amount "QPSA", the larger one of the maximum corrected air amount "QPS" provided by the bypass valve 27 and the corrected air amount "QPSU" provided by the equation (6) is selected. Accordingly, even when the load of the power steering pump 26 is varied, it never occurs that the air amount shows a shortage at an initial stage of the control because the idling speed control starts with the air amount corresponding to the maximum load of the power steering pump 26. Accordingly, the idling driveability of the engine is kept well even when the load of the power steering pump 26 is applied to the output of the engine.

The corrected air amount "QPSA" is corrected in view of the equivalent ratio "ϕ" and intake vacuum "QHO" as is defined by the equation (7). This means that the variation of the corrected air amount "QPSA" caused by a change of air/fuel ratio and that of an intake vacuum is easily derived, which makes the idling speed control by the invention simple.

The corrected air total amount "QLD" is calculated which corresponds to a total load of the air conditioner, the ratiator fan and the alternator. Based on the corrected air amount "QISC" (viz., QPSA+QLD), the air amount fed to the engine 10 is controlled by the throttle valve 23. Accordingly, even when the engine 10 is under idling operation with combustion of stratified charge requesting larger amount of air, suitable correction is automatically made to the air amount to satisfy the air request. That is, the idling driveability of the engine is not lowered even under such combustion.

The fuel injectors 18 and the ignition plug 19 are controlled in accordance with a high responsive F/F (feed-forward) control based on the corrected air amount "QADVFF". That is, in the invention, in addition to the correction in air amount, correction in view of an air flow timing delay is used for carrying out the idling speed control. That is, the idling speed control is achieved more precisely.

Figure 9:
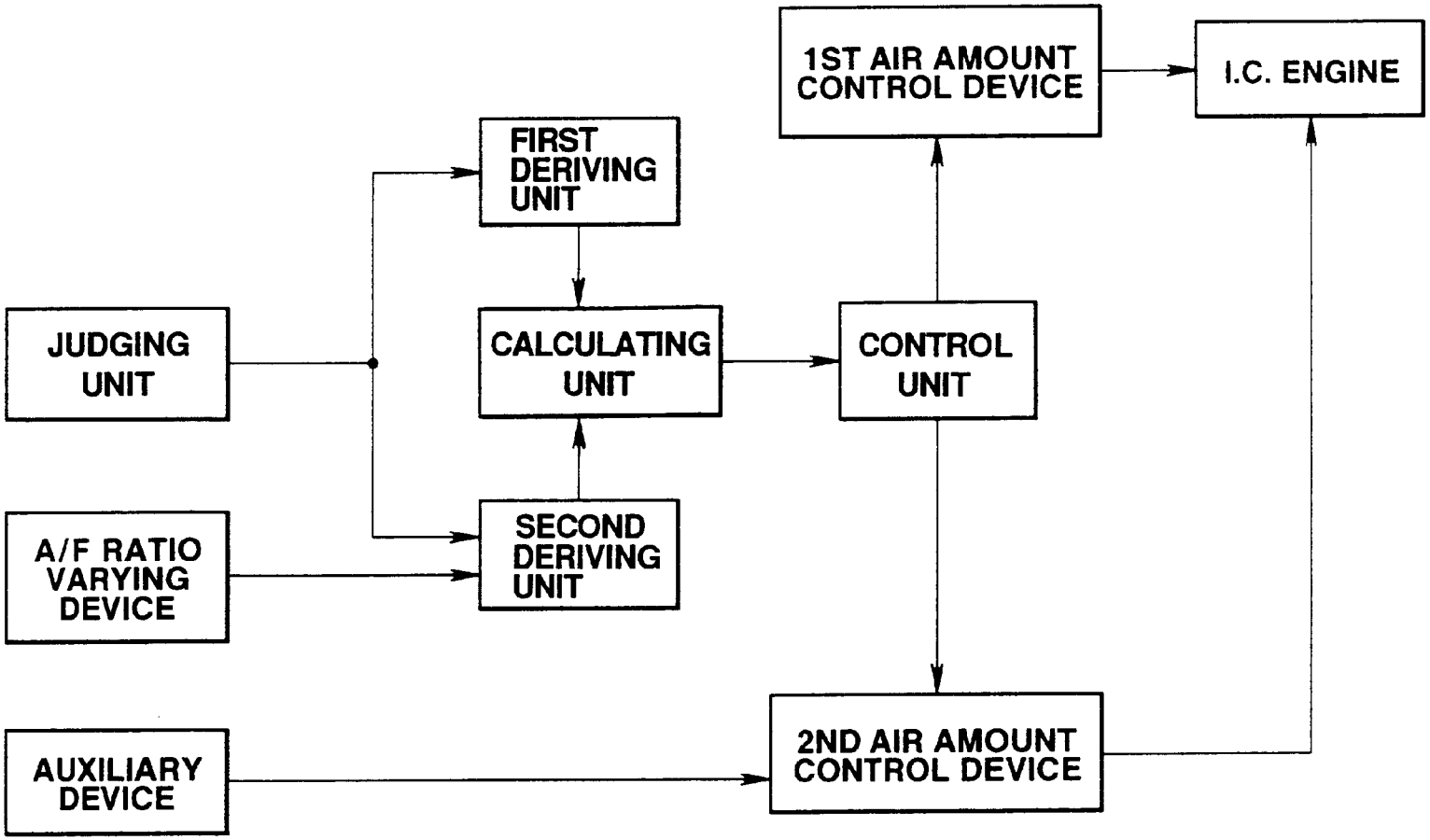
FIG. 9 is a block diagram showing the concept of the present invention.

The concept of the present invention is depicted by FIG. 9.

The contents of Japanese Patent Application 9-204460 filed Jun. 30, 1997 are hereby incorporated by reference.

The following, commonly assigned, U.S. Patent Applications relate to subject matter similar to that of the present application. (1) U.S. patent application Ser. No. 08/804,454 filed Feb. 21, 1997. (2) U.S. patent application Ser. No. 09/084,115 filed May 26, 1998, based on two Japanese Patent Applications 9-134585 and 9-134586. (3) U.S. patent application Ser. No. 09/102,366 filed Jun. 28, 1998, based on Japanese Patent Application 9-167613.

What is claimed is:

1. In an internal combustion engine having an auxiliary device powered by said engine, an idling speed control system comprising:

a first air amount control device which controls the amount of air fed to the engine in accordance with an operation condition of the engine;

a second air amount control device which controls the amount of air fed to the engine when a load of the auxiliary device is being applied to said engine;

an air/fuel ratio varying device which varies an air/fuel ratio of a mixture fed to the engine;

a judging unit which judges whether the load of the auxiliary device is actually applied to the engine or not;

a corrected air amount deriving unit which derives a corrected air amount which corresponds to a load of the auxiliary device under idling operation of the engine at a stoichiometric air/fuel ratio;

a needed air amount deriving unit which derives a needed air amount needed by the engine when the engine is idling at a target air/fuel ratio;

a difference calculating unit which calculates a difference between said corrected air amount and said needed air amount when said judging unit judges the application of the load of the auxiliary device to the engine; and a control unit which controls said first air amount control device to correct the air amount fed to the engine in accordance with said difference calculated by said difference calculating unit.

2. An idling speed control system as claimed in claim 1, wherein said first air amount control device includes an electrically controlled throttle valve.

3. An idling speed control system as claimed in claim 2, wherein said second air amount control device includes an electrically controlled bypass valve adapted to open automatically in response to the load of the auxiliary device being applied to the engine.

4. An idling speed control system as claimed in claim 1, wherein said second air amount control device is controlled in accordance with the load of the auxiliary device applied to the engine.

5. An idling speed control system as claimed in claim 1, further comprising a feed-back control device which controls said first air amount control device to bring an idling speed of the engine to a target value via a feed-back control technique.

6. An idling speed control system as claimed in claim 1, wherein the needed air amount derived by said needed air amount deriving unit is an amount of air actually needed by an air/fuel mixture which is being fed to the engine.

7. An idling speed control system as claimed in claim 1, wherein, for deriving the needed air amount, said needed air amount deriving unit makes a correction to said corrected air amount in accordance with an existing air/fuel ratio of the mixture which is being fed to the engine.

8. An idling speed control system as claimed in claim 7, further comprising an intake vacuum detecting unit which derives an intake vacuum appearing in an intake duct of the engine, and wherein said needed air amount deriving unit makes a correction to said needed air amount in accordance with the derived intake vacuum.

9. An idling speed control system as claimed in claim 1, wherein, for deriving the corrected air amount, said corrected air amount deriving unit selects a larger one of a basic air amount and a variable air amount which is lowered linearly with passage of time from a predetermined initial air amount, said predetermined initial air amount corresponding to a maximum load of the auxiliary device.

10. An idling speed control system as claimed in claim 9, further comprising an air flow timing delay correcting unit which corrects a delay of an air flow directed to the engine, said air flow timing delay correcting unit making a correction to the corrected air amount with reference to the air flow timing delay to derive an actually needed air amount which is actually fed to the engine.

11. An idling speed control system as claimed in claim 10, wherein said air flow timing delay correcting insert corrects at least one of the ignition timing and the injected fuel amount based on a difference between the corrected air amount and the actually needed air amount.

12. An idling speed control system as claimed in claim 1, wherein said engine is of a fuel direct injection type.

13. In an internal combustion engine having an auxiliary device which is incorporated therewith, a first air amount control device which controls the amount of air fed to the engine in accordance with an operation condition of the engine, a second air amount control device which controls the amount of air fed to the engine when a load of the auxiliary device is being applied to the engine and an air/fuel ratio varying device which varies an air/fuel ratio of a mixture fed to the engine, a method of controlling an idling speed of the engine, comprising the steps of:

determining whether the load of the auxiliary device is actually applied to the engine or not;

deriving a corrected air amount which corresponds to a load of the auxiliary device under idling operation of the engine at a stoichiometric air/fuel ratio;

deriving a needed air amount needed by the engine when the engine is idling at a target air/fuel ratio;

calculating a difference between said corrected air amount and said needed air amount when the load of the auxiliary device has been actually applied to the engine; and controlling the first air amount control device to correct the air amount fed to the engine in accordance with said difference.

* * * * *